United States Patent [19]

Hoffman et al.

[11] Patent Number: 4,718,644

[45] Date of Patent: Jan. 12, 1988

[54] SLAG SENSOR TAPHOLE ASSEMBLY

[75] Inventors: John P. Hoffman, Coopersburg, Pa.; David G. Hill, Michigan City, Ind.; Thomas Y. Ballock, Chesterton, Ind.; Roger E. Mays, Valporaiso, Ind.

[73] Assignee: Bethlehem Steel Corporation, Bethlehem, Pa.

[21] Appl. No.: 655,830

[22] Filed: Oct. 1, 1984

[51] Int. Cl.[4] ..... C21C 5/42

[52] U.S. Cl. ..... 266/99; 266/227

[58] Field of Search ..... 266/93, 94, 99, 78, 266/227, 236

[56] References Cited

FOREIGN PATENT DOCUMENTS 2456984 10/1976 Fed. Rep. of Germany ..... 266/227

OTHER PUBLICATIONS

"*Studsvik Report*", EMLI Slag Indication System, Mellberg et al, 3/9/82.

*Materials and Processing Databook* '81, "Metals Progress", 6/81, pp. 46–51.

*Primary Examiner*—L. Dewayne Rutledge

*Assistant Examiner*—S. Kastler

*Attorney, Agent, or Firm*—John J. Selko; John I. Iverson

[57] ABSTRACT

An improved slag sensor taphole nozzle assembly for a metallurgical vessel having electromagnetic coils protectively located in grooves in the nozzle sidewall, with the nozzle sidewall being (1) non-ferromagnetic and (2) having high electrical resistivity.

8 Claims, 10 Drawing Figures

FIG. 4
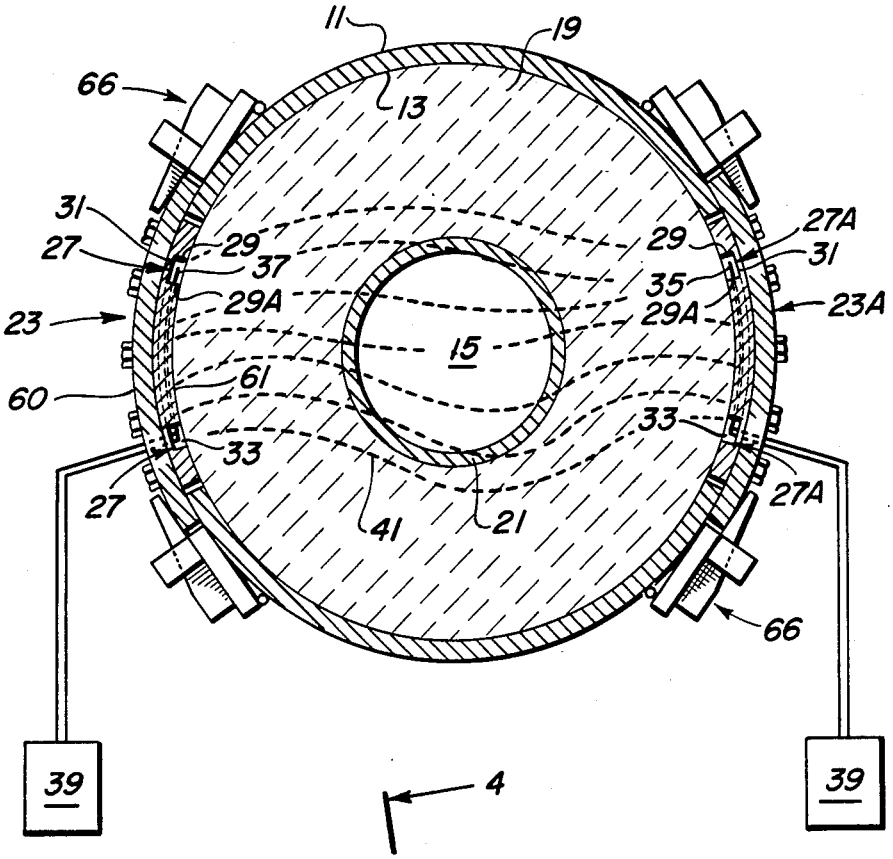
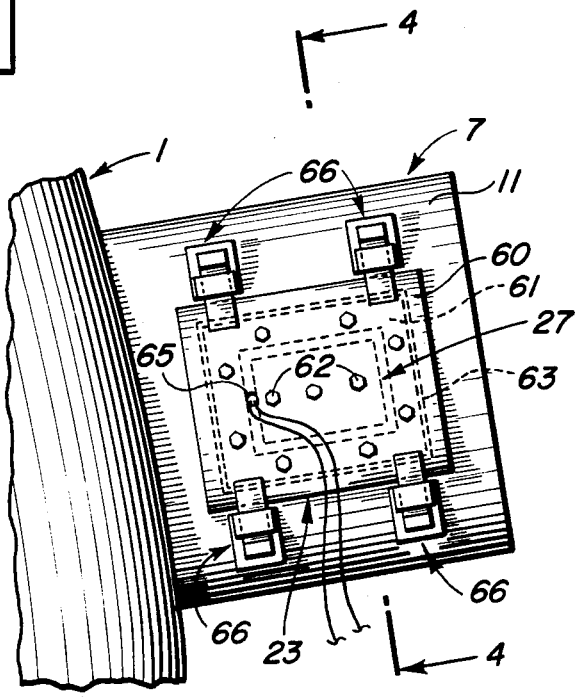
FIG. 5

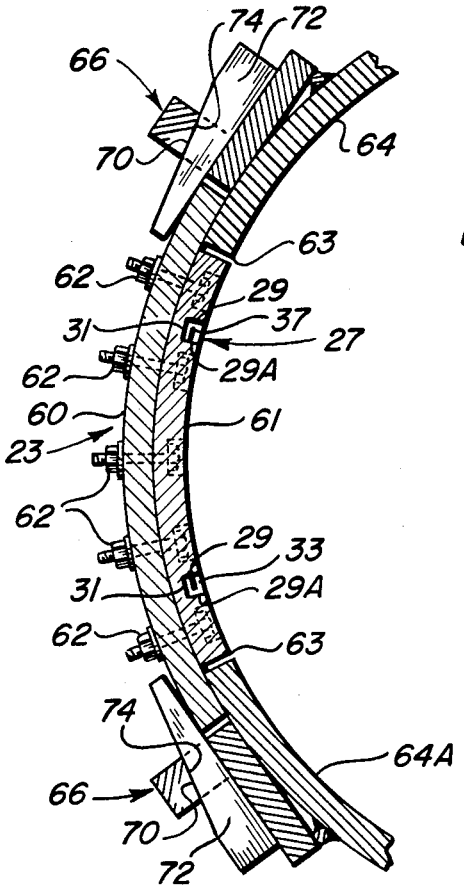
FIG. 6
FIG. 7
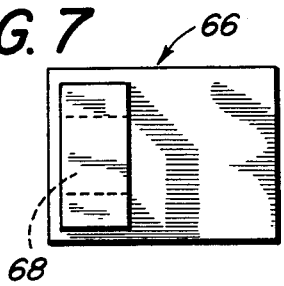
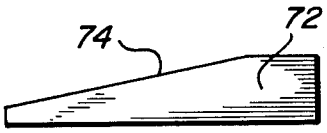
FIG. 10
FIG. 8
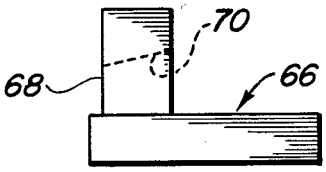
FIG. 9
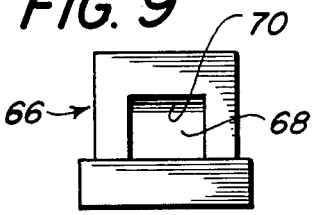

SLAG SENSOR TAPHOLE ASSEMBLY

BACKGROUND OF THE INVENTION

1. Field of the Invention

The present invention concerns an improved device for detecting and indicating the presence or absence of molten slag in the taphole nozzle of a metallurgical vessel containing a combination of molten metal and molten slag, and particularly in a basic oxygen furnace (BOF) containing molten steel and molten slag.

2. State of the Art

To reduce the transfer of slag from the BOF into the ladle during tapping of the furnace, a means is required to identify the onset of slag at the end of a furnace tap. In most installations, slag is visually detected by furnace operating personnel. An improved method uses electromagnetic detection principles to distinguish the change in electrical conductivity between the conductive steel, and the non-conductive slag in the furnace taphole.

A system operating on this principle operates as follows: Two sensor coils are installed inside the taphole nozzle. One coil, the transmitter coil, establishes an electromagnetic field through the taphole area, and the other coil, the receiver coil, measures the strength of the field. When the taphole is filled with an electrically conductive material such as steel, the transmitter coil field will be partially shielded and accordingly a lower amplitude field will be sensed by the receiver coil. With non-conductive slag in the taphole, the field will not be as well shielded and an increased amplitude field will be sensed.

A major difficulty in implementing this approach is that the sensor coils must be installed inside the taphole nozzle, and must be rugged and well protected to operate through an entire furnace refractory campaign. Should the coils fail during a campaign, it would be difficult to repair or replace them without incurring a major delay in furnace operation. Installation of the coils is further complicated by the practice used to periodically replace the taphole refractory. Taphole refractory changes are typically made every 50 heats. To change a taphole, all the refractory materials inside the taphole nozzle are removed using a large, remotely operated hydraulic ram that follows the interface between the refractory and outer metallic nozzle shell casting to break up the old refractory. Sensor coils must therefore be installed in such a manner that they will not be damaged by the ram during such a taphole change. However, usually the sensor coils are located at the interface between the metallic nozzle shell and the refractory material, and therefore, the coils are broken when the hydraulic ram moves along the interface between the metallic nozzle shell and the refractory, to remove the refractory. There is a need therefore for an improved device for positioning inside a taphole nozzle of a metallurgical vessel, such that any removal of refractory from the refractory/metallic nozzle interface will avoid damage to the coils.

There is also a need for such device which can be quickly and conveniently removed for repair during the vessel campaign.

SUMMARY OF THE INVENTION

The above objects can be achieved by an improved taphole nozzle assembly, having a metallic taphole nozzle with sides forming a central aperture, a pair of electromagnetic coils, each coil protectively located in a groove in generally opposing metallic sidewall portions of the nozzle, the sidewall portions being (1) non-ferromagnetic and (2) having high electrical resistivity. In a preferred embodiment the generally opposing sidewall portions are made from Type 316 stainless steel, and the opposing sidewall portions are removable from the nozzle assembly for ease of repair of the coils.

BRIEF DESCRIPTION OF THE DRAWINGS

FIG. 4 is a section along lines 4—4 of FIG. 5.

FIG. 5 is an elevational view, with parts removed, showing a taphole assembly with a removable sidewall portion.

FIG. 6 is an enlarged cross section along lines 4—4 of FIG. 5, with parts removed, FIG. 7 is a plan view of a retainer bracket.

FIG. 8 is an elevational view of a retainer bracket.

FIG. 9 is a side view of a retainer bracket.

FIG. 10 is an elevational view of a wedge for use with a retainer bracket.

DETAILED DESCRIPTION OF PREFERRED EMBODIMENT AND BEST MODE

Figure 1:
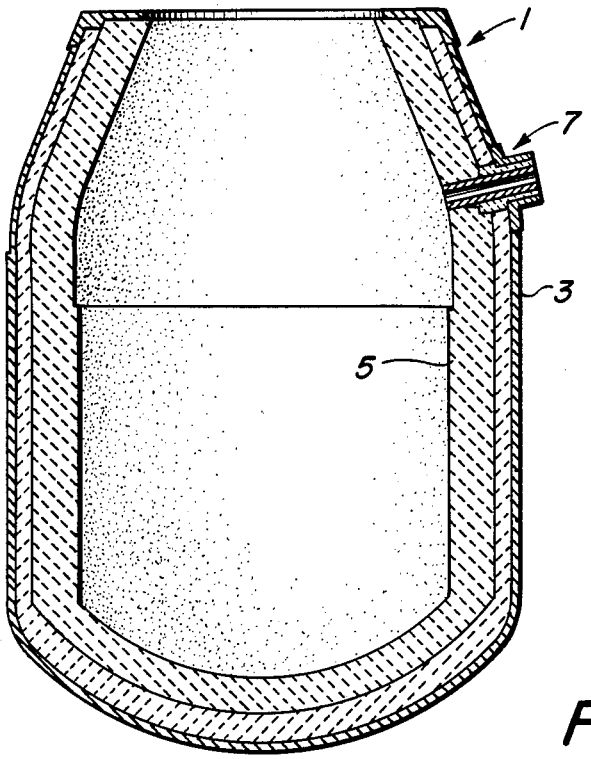
FIG. 1 shows an elevational cross sectional view of a metallurgical vessel and taphole for which this invention can be used.

As shown in FIG. 1, a typical metallurgical vessel, in this case, a basic oxygen furnace (BOF) shown generally at 1 includes an outer metallic shell 3 and an inner refractory lining 5. The lining 5 is comprised of a plurality of courses of refractory bricks, as is well known. Extending through the outer shell 3 and lining 5 is a taphole shown generally as 7.

Figure 2:
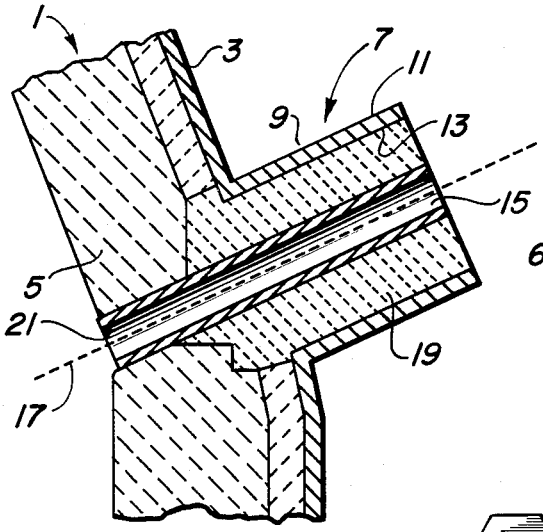
FIG. 2 shows an enlarged cross sectional view of a BOF taphole assembly.

As shown in FIG. 2, the taphole includes a metallic taphole nozzle 9 having sides 11 extending outwardly from the shell 3. The inner surface 13 of the sides 11 form a central aperture 15 which is concentric, or coaxially aligned, with taphole 7, as shown by common axis 17. Refractory material 19, of any well known composition, covers inner surface 13 of sides 11 to protect the taphole against the effects of molten metal and slag, all as is well known. A refractory alumina central tube 21 defines the aperture 15 concentric with axis 17 as described above.

Figure 3:
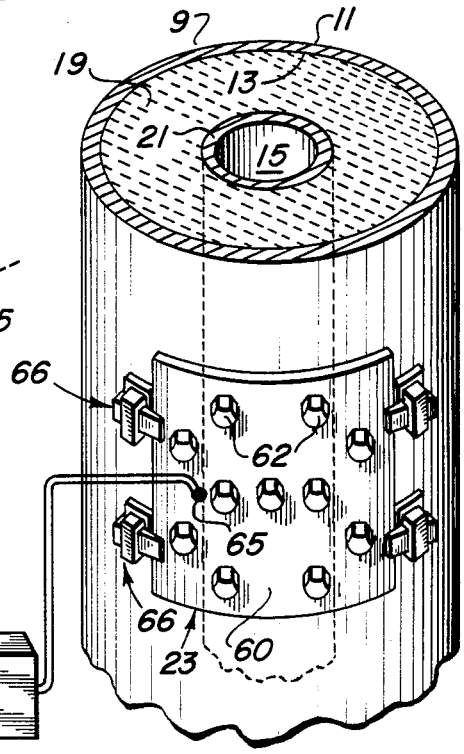
FIG. 3 shows an enlarged schematic perspective view of the taphole assembly of this invention, with parts of the BOF vessel removed.

As shown in FIGS. 3 and 4, nozzle 9 includes a pair of metallic sidewall portions 23 and 23A spaced in generally opposing relationship. Each of the sidewall portions 23, 23A has a closed loop groove 27, 27A in the inner surface thereof. Each groove 27, 27A is formed by sides 29, 29A and bottom surface 31, with opening 33 oriented adjacent the axis 17 of taphole 7.

Each groove 27, 27A has an electromagnet coil 35, 37, respectively, therein. Grooves 27, 27A are of sufficient depth to permit the coil 35, 37 to be positioned completely below the inner surface 13 of sides 11. Each coil 35, 37 is connected to electronic equipment 39, via suitable wiring that extends through aperture 65, such that coils 35, 37 and equipment 39 form in combination means for detecting and indicating the presence or absence of molten slag or metal, by well known and conventional eddy current and magnetic field principles. Such eddy current/magnetic field means could be as described in U.S. Pat. Nos. 4,138,888 issued Feb. 13, 1979, or 4,144,756 issued Mar. 20, 1979, both to Stan. V. Linder. However, the commercial device sold as EMLI Metal Level Indicator 3968D, and EMLI Slagindicator 3981A by Studsvik Energiteknik AB of Sweden is preferred. It should be understood that the specific electronic circuitry for generating eddy currents and measuring slag or metal form no part of this invention. However, as is well known, one coil, for example 35, would act as a transmitter of magnetic field lines, shown schematically as 41, and the second coil 37 would act as a receiver, or detector, to measure the strength of the field and variations of such field as a result of presence or absence of metal or slag in the nozzle aperture 15.

Heretofore, it has been believed by those skilled in this art that it is necessary to position coils 35, 37 on the inner surface 13 (but not below it), at the interface of inner surface 13 and refractory material 19 because if coils 35, 37 were positioned below surface 13, with a metallic surface adjacent to the coil, i.e. sides 29, 29A of groove 27, 27A, which metallic surface is (1) ferromagnetic and (2) has low electrical resistivity of the type typically used in steel members used for taphole nozzles, the field strength generated by coil 35 would not have sufficient strength to effectively penetrate across the width of taphole 7, to generate a strong enough magnetic field for effective detecting and utilization by coil 37.

However, we have discovered that by careful selection of the characteristics of the sidewall in which the coils 35, 37 are located, that coils 35, 37 can, indeed, be located below the inner surface 13 and, thus, in a protected position. We have discovered that if sidewall portions 23, 23A are (1) non-ferromagnetic, and at the same time, are (2) high in electrical resistivity, that coils 35, 37 can be below surface 13. By non-ferromagnetic, we mean materials having a relative magnetic permeability to a magnetic field less than 2.0 and preferably as close to 1.0 as possible. As one skilled in the art would recognize, a non-ferromagnetic material with a relative permeability less than 2.0 would not be noticeably or strongly attracted to a magnet, thus providing a simple test for determining what is non-ferromagnetic, as is useful in this invention. By high in electrical resistivity we mean any material having a resistivity measured in microhm - cm higher than 5.0. In the preferred embodiment the electrical resistivity typically is in the range 57–78 microhm - cm. Examples of metallic materials which exhibit the proper combination of (1) and (2) above can be selected from the group consisting of stainless steel Types 316, 304, 308, as well as tantalum, tungsten and the families of alloys known as Monel, Inconel, and Hastelloy.

Finally, as shown in FIG. 4, suitable refractory 19 and alumina central tube 21 cover inner surface 13, groove opening 33 and coils 35 and 37 for protection against molten slag and metal.

It would be sufficient to fabricate the entire taphole nozzle 9 out of the materials identified above, with grooves 27, 27A therein as described above. However, for ease of maintenance during the campaign life of a BOF vessel, it is preferred to make sidewall portions 23, 23A removable from taphole nozzle 9 as hereinafter described. Referring to FIG. 5 and 6, there is shown a removable sidewall portion 23. Only one sidewall portion 23 is described, but sidewall portion 23A is similar.

Sidewall portion 23 has a backing plate 60 fastened to the coil-carrying sidewall section 61 by conventional means, such as bolts 62. Backing plate 60 overlies against fixed sidewall portion 64, 64A of nozzle 9. Backing plate 60 can be either of the same type of material as sidewall portion 23, i.e. non-ferromagnetic and high in electrical resistivity, or plate 60 can be ferromagnetic material with a low electrical resistivity. We prefer the latter. Inner surface 13 of removable sidewall portion is preferred to be flush with the inner surface of adjoining fixed sidewall portions 64, 64A. However, it would be equivalent if coil-carrying section 61 of removable sidewall portion 23 extended somewhat into the interior of the nozzle 9, but the edges of the sidewall portion so extending should be bevelled, so as to permit the hydraulic ram to ride up and over the sidewall portion, when the ram follows the refractory/metal interface during removal of refractory. A plurality of retainer brackets 66 is fixed to fixed wall portion 64, 64A. Each retainer bracket 66 includes an aperture 68 therethrough having an angled friction surface 70 for frictionally engaging a removable wedge 72. Wedge 72 has an inclined frictional surface 74 for engaging surface 70.

Thus, it can be understood that removable sidewall wall portion 23 fits into an aperture 63 in fixed wall portion 64, 64A and is held in place by wedges 72 engaging retainer brackets 66. By removing wedges 72, such as with a hammer, wall portion 23 can be removed.

It would be sufficient to fabricate only removable sidewall portions 23, 23A from a material which is (1) non-ferromagnetic and (2) has high electrical resistivity. The balance of the nozzle 9, i.e. fixed sidewall portions can be fabricated from the usual metallic material used for such nozzles.

While we have disclosed a taphole nozzle having a generally circular cross section, with the pair of opposed wall portions diametrically opposed, it would be equivalent to provide a square or rectangular or elliptical cross section for the nozzle, with generally opposed sidewall portions.

While we have disclosed a taphole for a BOF, it would be equivalent to utilize the invention in any metallurgical vessel for ferrous molten metal and slag with which an eddy current/magnetic field coil detector system can be utilized.

We claim:

1. In a metallurgical vessel for processing a combination of molten ferrous metal and slag, said vessel having an outer metallic shell and an inner refractory lining with a taphole extending through said outer shell and refractory lining, the improved taphole assembly comprising:

(a) a metallic taphole nozzle having sides extending outwardly from said shell, the inner surface of said sides forming a central aperture concentric with said taphole;

(b) said nozzle including a pair of metallic sidewall portions spaced in generally opposing relationship, said opposing sidewall portions comprising a non-ferromagnetic alloy metal having a relative permeability less than 2.0 and an electrical resistivity of at least 5.0 microhm-cm;

(c) each of said opposing sidewall portions having a closed loop groove in the inner surface thereof;

(d) each groove having an electromagnetic coil therein, said groove being of sufficient depth to permit said coil to be positioned completely below the inner surface of said sidewall;

(e) means in combination with said electromagnetic coils for indicating the presence or absence of slag; and (f) refractory means covering said inner surface of said nozzle and said coils for protection against molten metal and slag.

2. The invention of claim 1 in which said opposing sidewall portions are made from Type 316 stainless steel.

3. The invention of claim 1 in which said opposing sidewall portions are removable from said nozzle.

4. In a metallurgical vessel for processing a combination of molten ferrous metal and slag, said vessel having an outer metallic shell and an inner refractory lining with a taphole extending through said outer shell and refractory lining, the improved taphole assembly comprising:

(a) a metallic taphole nozzle having sides extending outwardly from said shell, the inner surface of said sides forming a central aperture concentric with said taphole;

(b) said nozzle including a pair of removable metallic sidewall portions spaced in generally opposing relationship;

(c) said removable sidewall portions comprising a non-ferromagnetic alloy metal having a relative permeability less than 2.0 and an electrical resistivity of at least 5.0 microhm-cm;

(d) each of said removable sidewall portions having a closed loop groove in the inner surface thereof;

(e) each groove having an electromagnetic coil therein, said groove of sufficient depth to permit said coil to be positioned completely below the inner surface of said wall;

(f) means in combination with said electromagnetic coils for indicating the presence or absence of slag; and (g) refractory means covering said inner surface of said nozzle and said coils for protection against molten metal and slag.

5. The invention of claim 4 in which the inner surface of each removable sidewall portion is essentially flush with the inner surface of an adjoining fixed sidewall portion of said nozzle.

6. In a metallurgical vessel for processing a combination of molten ferrous metal and slag, said vessel having an outer metallic shell and an inner refractory lining, the improvement comprising:

(a) said metallic shell including a pair of metallic sidewall portions spaced in generally opposing relationship, said opposing sidewall portions comprising a non-ferromagnetic alloy metal having a relative permeability less than 2.0 and an electrical resistivity of at least 5.0 microhm-cm;

(b) each of said opposing sidewall portions having a closed loop groove in the inner surface thereof;

(c) each groove having an electromagnetic coil therein, said groove being of sufficient depth to permit said coil to be positioned completely below the inner surface of said sidewall;

(d) means in combination with said electromagnetic coils for indicating the presence or absence of slag; and (e) refractory means covering said inner surface and said coils for protection against molten metal and slag.

7. The invention of claim 6 in which said opposing sidewall portions are made from Type 316 stainless steel.

8. The invention of claim 7 in which said opposing sidewall portions are removable from said metallic shell.

* * * * *